US009614292B2

(12) United States Patent
Wang et al.

(10) Patent No.: US 9,614,292 B2
(45) Date of Patent: Apr. 4, 2017

(54) CIRCULARLY POLARIZED ANTENNA

(71) Applicant: Honeywell International Inc., Morristown, NJ (US)

(72) Inventors: Nan Wang, Shang Hai (CN); Orville Nyhus, Glendale, AZ (US)

(73) Assignee: Honeywell International Inc., Morris Plains, NJ (US)

( * ) Notice: Subject to any disclaimer, the term of this patent is extended or adjusted under 35 U.S.C. 154(b) by 438 days.

(21) Appl. No.: 13/978,158

(22) PCT Filed: Mar. 1, 2013

(86) PCT No.: PCT/CN2013/072064
§ 371 (c)(1),
(2) Date: Jul. 3, 2013

(87) PCT Pub. No.: WO2014/131195
PCT Pub. Date: Sep. 4, 2014

(65) Prior Publication Data

US 2015/0116185 A1 Apr. 30, 2015

(51) Int. Cl.
*H01Q 21/26* (2006.01)
*H01Q 21/22* (2006.01)
*H01Q 21/24* (2006.01)

(52) U.S. Cl.
CPC ..... *H01Q 21/22* (2013.01); *H01Q 21/24* (2013.01)

(58) Field of Classification Search
USPC ..... 343/700 MS, 702, 797, 774, 818, 357
See application file for complete search history.

(56) References Cited

U.S. PATENT DOCUMENTS 4,109,255 A 8/1978 Silliman
4,160,976 A 7/1979 Conroy
6,040,806 A 3/2000 Kushihi et al.
(Continued)

OTHER PUBLICATIONS

Honda et al., "A Disk Monopole Antenna with 1:8 Impedance Bandwidth and Omnidirectional Radiation Pattern", "Proceedings of ISAP '92; at least as early as Dec. 1992", 1992, pp. 1145-1148.
(Continued)

*Primary Examiner* — Hoang V Nguyen
*Assistant Examiner* — Hai Tran
(74) *Attorney, Agent, or Firm* — Fogg and Powers LLC

(57) ABSTRACT

A broad-band circularly-polarized antenna is presented. The circularly-polarized antenna includes at least four monopole antenna elements having respective at least four radiating surfaces with respective at least four normals. The monopole antenna elements are arranged around a vertical axis. The normals of the respective radiating surfaces are perpendicular to and point away from the vertical axis. The broad-band circularly-polarized antenna includes at least one feed network communicatively coupled to edge portions of the at least four monopole antenna elements. A first antenna element is driven with a first driving phase offset by 90 degrees from a second driving phase used to drive a second antenna element. The second driving phase is offset by 90 degrees from a third driving phase used to drive a third monopole antenna element. The third driving phase is offset by 90 degrees from a fourth driving phase used to drive a fourth antenna element.

18 Claims, 9 Drawing Sheets

(56) References Cited

U.S. PATENT DOCUMENTS

| | | | | |
|---|---|---|---|---|
| 6,473,054 | B1 | 10/2002 | Lopez et al. | |
| 7,782,266 | B2 | 8/2010 | Chang et al. | |
| 8,217,850 | B1 | 7/2012 | Jennings et al. | |
| 8,269,686 | B2 | 9/2012 | Johnston et al. | |
| 2003/0210207 | A1* | 11/2003 | Suh | H01Q 1/38 343/895 |
| 2007/0254587 | A1 | 11/2007 | Schadler et al. | |
| 2009/0156118 | A1 | 6/2009 | Schadler | |
| 2009/0204372 | A1* | 8/2009 | Johnston | G01S 19/22 702/191 |
| 2009/0267850 | A1 | 10/2009 | Parsche | |
| 2009/0284351 | A1 | 11/2009 | Rossman et al. | |
| 2010/0053006 | A1 | 3/2010 | Miyoshi et al. | |
| 2010/0141530 | A1* | 6/2010 | McMahon | H01Q 1/246 342/417 |
| 2010/0207811 | A1* | 8/2010 | Lackey | G01S 19/21 342/357.44 |
| 2011/0063171 | A1 | 3/2011 | Lopez | |
| 2012/0212386 | A1 | 8/2012 | Massie et al. | |
| 2012/0242553 | A1 | 9/2012 | Leung et al. | |
| 2012/0299789 | A1 | 11/2012 | Orban et al. | |

OTHER PUBLICATIONS

Hori et al., "Ultra-Wideband Monopole Antenna with Rounded Disc Element on Finite Ground Plane", Dec. 2007, pp. 1-5, Publisher: University of Fukui, Japan.

Lee et al., "A Wideband Planar Monopole Antenna Array with Circular Polarized and Band-Notched Characteristics", "Progress in Electromagnetics Research", Jun. 2012, pp. 381-398, vol. 128.

Liang et al., "Study of a Printed Circular Disc Monopole Antenna for UWB Systems", "IEEE Transactions on Antennas and Propagation", Nov. 2005, pp. 3500-3504, vol. 53, No. 11.

Pillalamarri et al., "Printed UWB Circular and Modified Circular Disc Monopole Antennas", "International Journal of Recent Trends in Engineering, Issue 1", May 2009, pp. 12-15, vol. 1.

Zhong et al., "Study of a Circular Disc Monopole Ultrawide-Band Miniature Antenna", "PIERS Online", Apr. 2008, pp. 326-330, vol. 4, No. 3.

European Patent Office, "Extended European Search Report from EP Application No. 13876280.2 mailed Dec. 22, 2016", "from foreign counterpart of U.S Appl. No. 13/978,158", Dec. 22, 2016, pp. 1-9, Published in: EP.

* cited by examiner

CIRCULARLY POLARIZED ANTENNA

BACKGROUND

The circularly-polarized antenna is used extensively in global positioning system (GPS), satellite, and radar applications. In the ground station of a particular application, a circularly-polarized antenna requires a good axial ratio (AR) everywhere above the horizon from the zenith (directly overhead) to very low elevation angles near the horizon. As is known in the art, the axial ratio is the ratio of vertical electric field ($E_{vert}$) component and the horizontal electric field ($E_{hor}$) component of the radiation. Some traditional designs, such as microstrip patches or helix antennas, are not usable as circularly-polarized antennas due to their poor AR at low elevation angles.

To improve the axial ratio of polarization antennas at low elevation angles (e.g., at elevations within 25 degrees of the horizon), a three-dimensional (3D) spatial structure is required. Some prior art circularly-polarized antennas include four dipoles arranged at a 45 degree orientation angle relative to the horizontal plane and in which each opposing pair of dipoles is mutually perpendicular. It is difficult to maintain this precise perpendicular orientation between opposite pair of dipoles. Significant mechanical engineering (ME) is required to design the assembling fixture, special ME supports, special ME assembling methods and, perform the analysis to ensure long term quality.

For the reasons stated above and for other reasons stated below which will become apparent to those skilled in the art upon reading and understanding the specification, there is a need in the art for improved systems and method.

SUMMARY

The embodiments of the present invention provide methods and systems for a circularly polarized antenna and will be understood by reading and studying the following specification.

The present application relates to a broad-band circularly-polarized antenna including at least four monopole antenna elements having respective at least four radiating surfaces with respective at least four normals, the at least four monopole antenna elements arranged around a vertical axis so that the at least four normals of the at least four respective radiating surfaces are perpendicular to the vertical axis and point away from the vertical axis; at least one feed network communicatively coupled to at least four respective edge portions of the at least four monopole antenna elements. A first monopole antenna element is driven with a first driving phase offset by 90 degrees from a second driving phase used to drive a second monopole antenna element. A second radiating surface of the second monopole antenna element is orthogonally arranged with reference to a first radiating surface of the first monopole antenna element. The second driving phase is offset by 90 degrees from a third driving phase used to drive a third monopole antenna element. A third radiating surface of the third monopole antenna element is orthogonally arranged with reference to the second radiating surface of the second monopole antenna element. The third radiating surface of the third monopole antenna element is oppositely directed from the first radiating surface of the first monopole antenna element. The third driving phase is offset by 90 degrees from a fourth driving phase used to drive a fourth monopole antenna element. A fourth radiating surface of the fourth monopole antenna element is orthogonally arranged with reference to both the third radiating surface of the third monopole antenna element and the first radiating surface of the first monopole antenna element. The fourth radiating surface of the fourth monopole antenna element is oppositely directed from the second radiating surface of the second monopole antenna element.

DRAWINGS

Embodiments of the present invention can be more easily understood and further advantages and uses thereof more readily apparent, when considered in view of the description of the preferred embodiments and the following figures in which.

Figure 4:
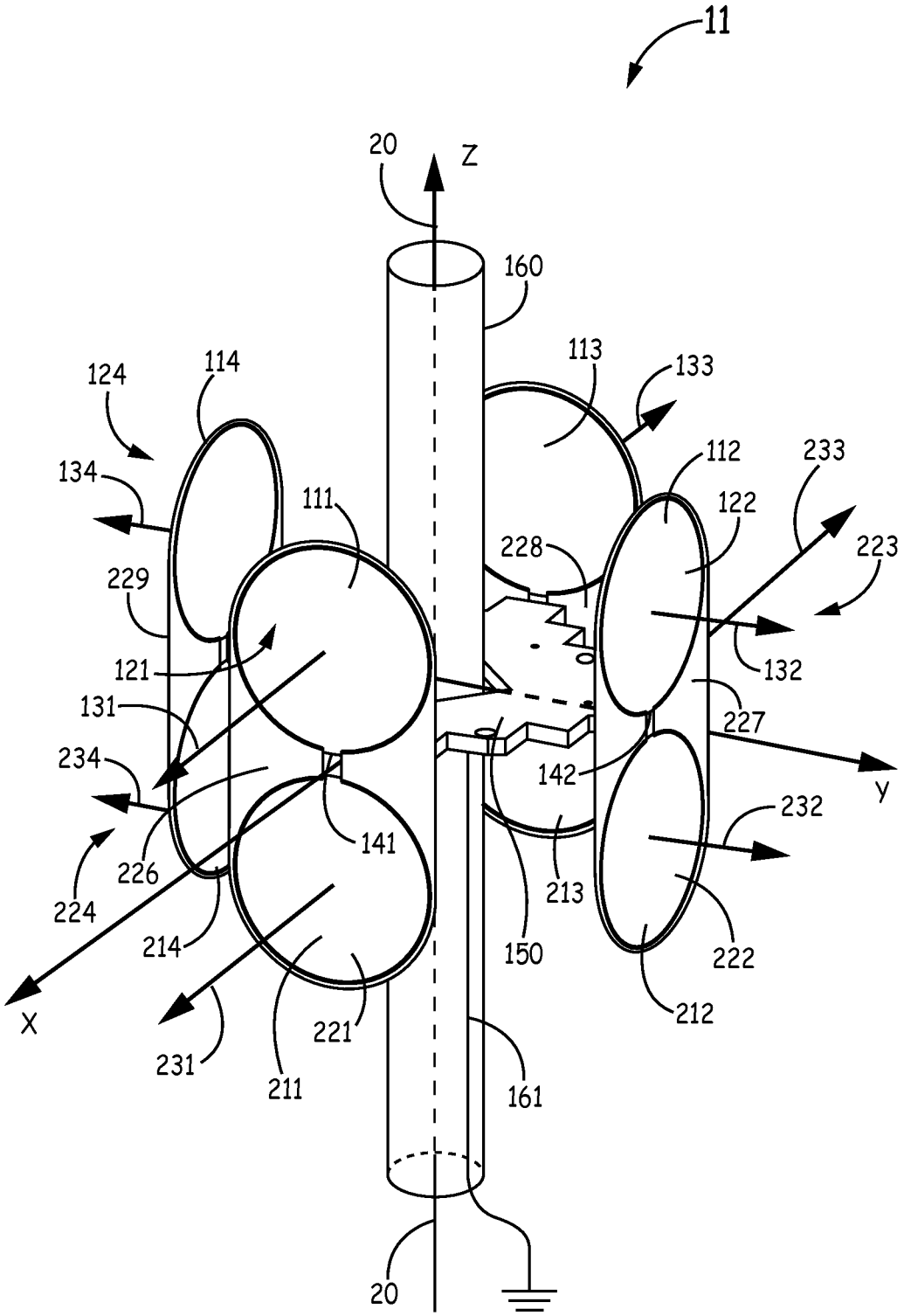
FIG. 4 is an oblique view of an embodiment of a bay of monopole antenna elements that form a broad-band circularly-polarized antenna in accordance with the present invention.
Figure 8:
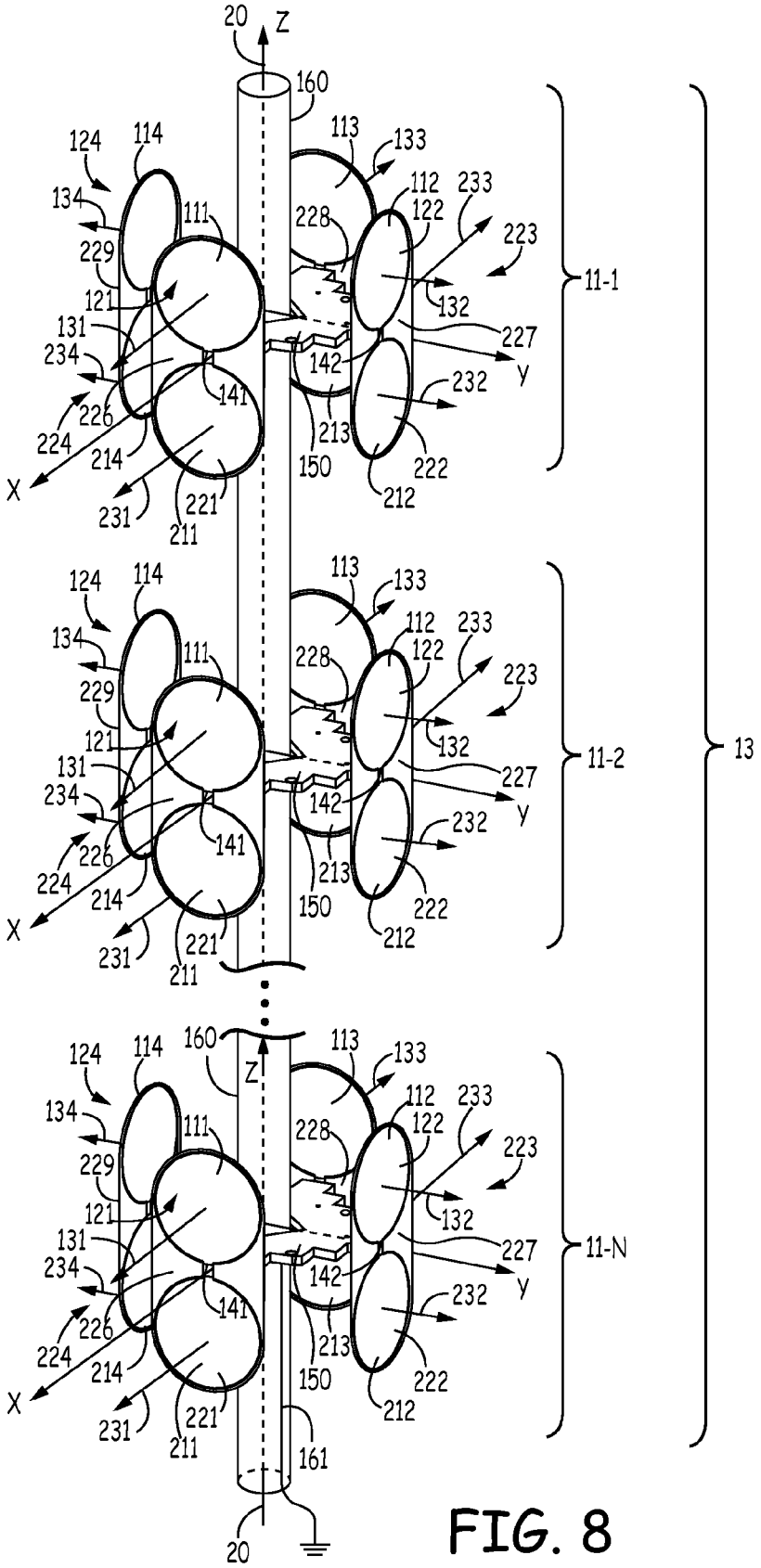
Figure 9:
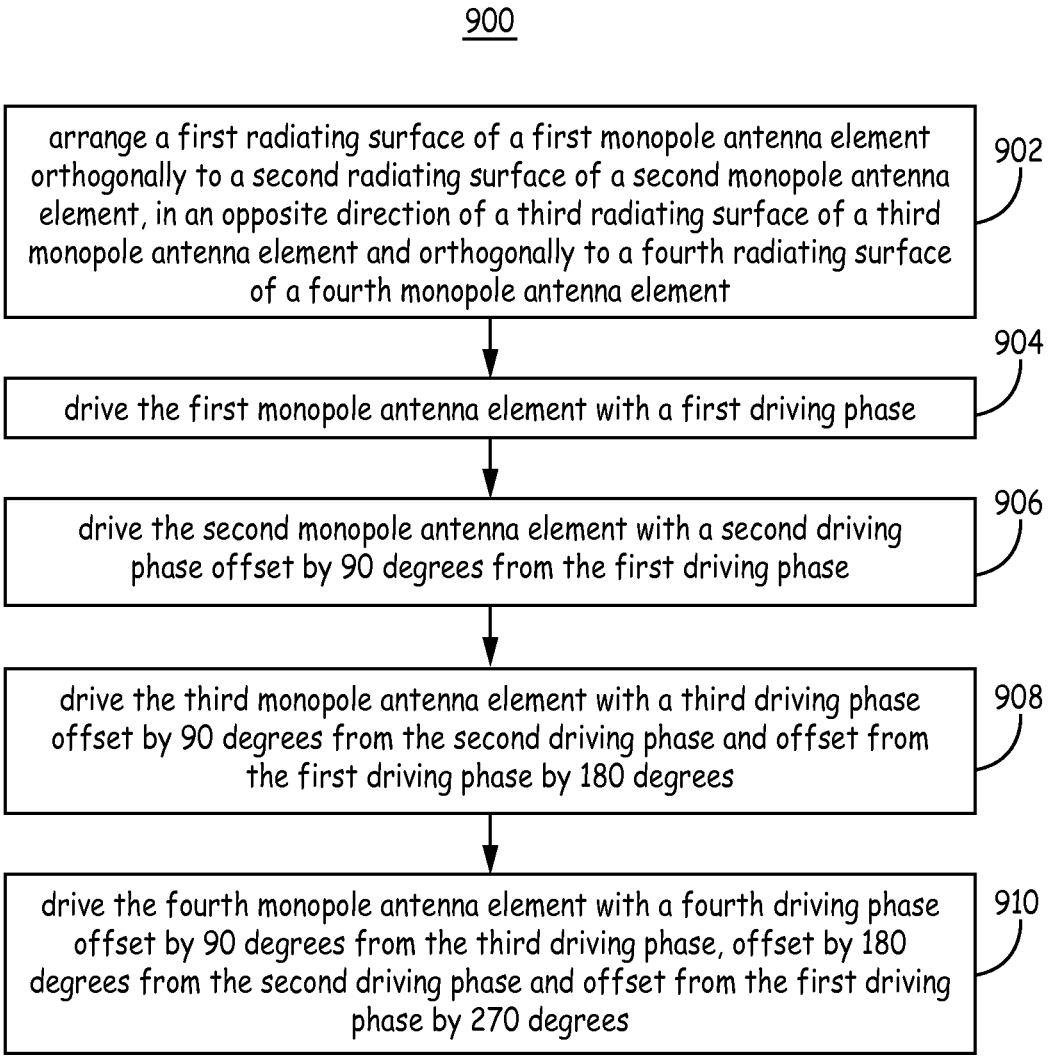

FIG. 8 is an oblique view of an embodiment of a plurality of broad-band circularly-polarized antennas of FIG. 4 that share the same vertical axis and form a broad-band circularly-polarized antenna in accordance with the present invention; and FIG. 9 is a method of generating broadband circularly-polarized radiation using a broad-band circularly-polarized antenna in accordance with the present invention.

In accordance with common practice, the various described features are not drawn to scale but are drawn to emphasize features relevant to the present invention. Reference characters denote like elements throughout figures and text.

DETAILED DESCRIPTION

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical, and electrical changes may be made without departing from the scope of the present invention. The following detailed description is, therefore, not to be taken in a limiting sense.

In this document, a circularly polarized antenna is described which overcomes the above mentioned problems and which achieves a wider operating frequency band than currently available circularly polarized antennas. Embodiments of the present application include at least four monopole antenna elements. Each monopole antenna element has a radiating surface. The monopole antenna elements arranged around a vertical axis so that the normals of the respective radiating surfaces are perpendicular to the vertical axis and point away from the vertical axis. A feed network to drive each monopole antenna element is communicatively coupled to the four monopole antenna elements at four respective edge portions of the four monopole antenna elements. When the phase is driving the first, second, third, and fourth monopole antenna elements at 0°, −90°, −180°, and −270° phase angle, respectively, the electric fields radiated from the circularly polarized antenna are right-hand-circular-polarization (RHCP) for elevation angles above the horizon, and are left-hand-circular-polarization (LHCP) for some elevation angles significantly below the horizon. By reversing the driving phase angle to 0°, +90°, +180°, +270° to the respective first, second, third, and fourth monopole antenna elements, the radiated fields are LHCP for elevation angles above the horizon, and are RHCP for some elevation angles significantly below the horizon.

Each monopole antenna element is perpendicularly assembled with respect to a central structure. The central structure is as a mechanical support and a radio frequency (RF) ground connection. At least four monopole antenna elements are connected to the same signal ground reference. Each antenna element is a monopole radiator. The radiated electric field (E-field) of the basic radiated unit covers all elevations from vertical (0°) to horizontal) (90°) over 360° of azimuth. Based on the phase angle at which the monopole antenna elements are driven, the radiated E-field of opposing pairs of antennas is perpendicular. The total antenna array creates circular polarization at very low elevation angles. The simplest topology is four monopole broadband radiators (antenna elements) positioned above the horizon. In one implementation of this embodiment, four imaged non-fed monopole broadband radiators are arranged symmetrically below the horizon. The four imaged non-fed monopole broadband radiators are connected to a suitable load impedance to optimize the axial ratio.

Figure 1:
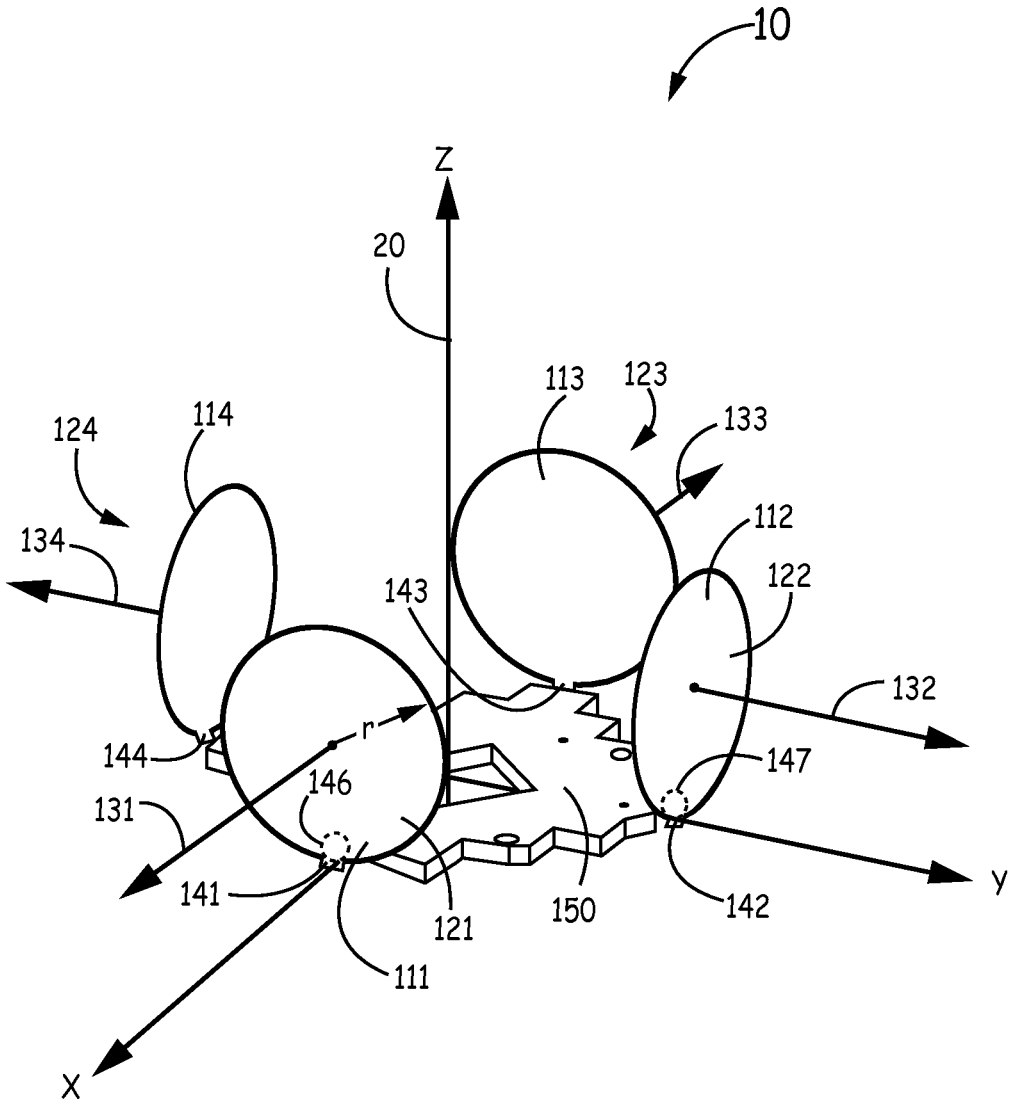
FIG. 1 is an oblique view of an embodiment of a broad-band circularly-polarized antenna in accordance with the present invention.
Figure 2:
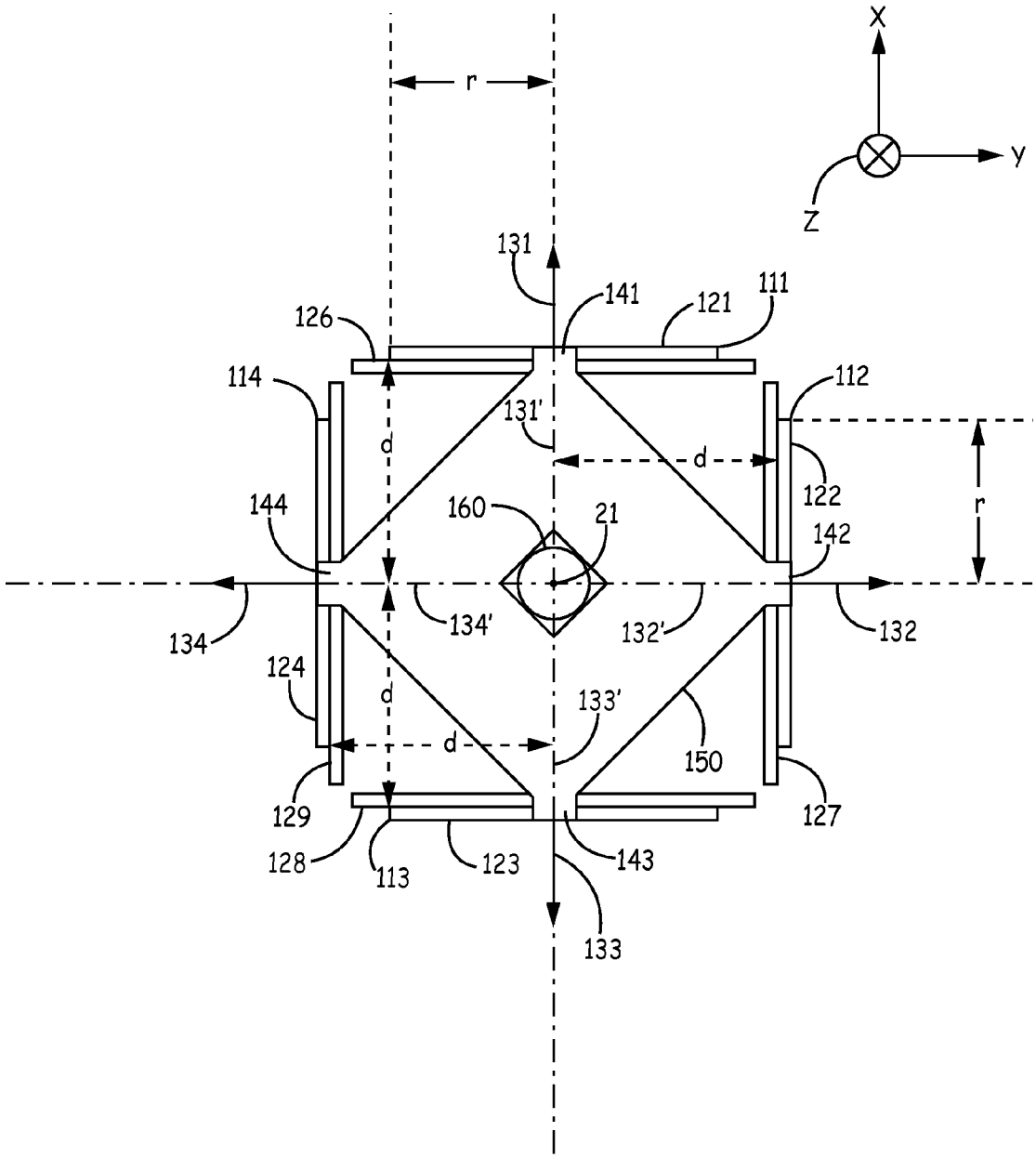
FIG. 2 is a view in the positive Z direction of the broad-band circularly-polarized antenna of FIG. 1.

FIG. 1 is an oblique view of an embodiment of a broad-band circularly-polarized antenna 10 in accordance with the present invention. FIG. 2 is a view in the positive Z direction of the broad-band circularly-polarized antenna 10 of FIG. 1. In FIG. 2, the broad-band circularly-polarized antenna 10 is seen looking in the positive z direction along the z-axis. The broad-band circularly-polarized antenna 10 includes four monopole antenna elements 111-114 having four respective radiating surfaces 121-124. When the broad-band circularly-polarized antenna 10 is in operation, the electro-magnetic fields are emitted from the radiating surfaces 121-124 so that the broad-band circularly-polarized antenna 10 emits circularly polarized radiation (or nearly circularly polarized radiation) at all elevations from vertical (0°) to horizontal (90°) over 360° of azimuth. The normal for each radiating surface 121-124 is represented as a respective arrow 131-134.

The four monopole antenna elements 111-114 are arranged around a vertical axis 20 (shown in the z-direction) so that the four normals 131-134 of the at least four respective radiating surfaces 121-124 are perpendicular to the vertical axis 20 (i.e., in the y-z plane) and point away from the vertical axis 20. A feed network 150 is communicatively coupled to respective edge portions of the four monopole antenna elements 111-114.

The first monopole antenna element 111 has a first radiating surface 121 with a first normal 131. A first edge portion 146 of the first monopole antenna element 111 is connected to the feed network 150 via a first contact region 141 of the feed network 150.

The second monopole antenna element 112 has a second radiating surface 122 with a second normal 132. A second edge portion 147 of the second monopole antenna element 112 is connected to the feed network 150 via a second contact region 142 of the feed network 150. The second radiating surface 122 of the second monopole antenna element 112 is orthogonally arranged with reference to the first radiating surface 121 of the first monopole antenna element 111.

The third monopole antenna element 113 has a third radiating surface 123 with a third normal 133. A third edge portion (not visible) of the third monopole antenna element 113 is connected to the feed network 150 via a third contact region 143 of the feed network 150. The third radiating surface 123 of the third monopole antenna element 113 is orthogonally arranged with reference to the second radiating surface 122 of the second monopole antenna element 112. The third radiating surface 123 of the third monopole antenna element 113 is oppositely directed from the first radiating surface 121 of the first monopole antenna element 111 (i.e., normal 131 is oppositely directed from normal 133).

The fourth monopole antenna element 114 has a fourth radiating surface 124 with a fourth normal 134. A fourth edge portion (not visible) of the fourth monopole antenna element 114 is connected to the feed network 150 via a fourth contact region 144 of the feed network 150. The fourth radiating surface 124 of the fourth monopole antenna element 114 is orthogonally arranged with reference to both the third radiating surface 123 of the third monopole antenna element 113 and the first radiating surface 121 of the first monopole antenna element 111. The fourth radiating surface 124 of the fourth monopole antenna element 114 is oppositely directed from the second radiating surface 122 of the second monopole antenna element 112 (i.e., normal 132 is oppositely directed from normal 134).

The first monopole antenna element 111 is driven with a first driving phase that is offset by 90 degrees from a second driving phase that is used to drive the second monopole antenna element 112. The second monopole antenna element 112 is driven with a second driving phase is offset by 90 degrees from a third driving phase that is used to drive the third monopole antenna element 113. The third driving phase is offset by 90 degrees from a fourth driving phase used to drive the fourth monopole antenna element 114.

In order to radiate right-hand-circular-polarization electro-magnetic fields from the broad-band circularly-polarized antenna 10, the first monopole antenna element 111 is driven with the first driving phase of 0 degrees, the second monopole antenna element 112 is driven with the second driving phase of −90 degrees, the third monopole antenna element 113 is driven with the third driving phase of −180 degrees, and the fourth monopole antenna element 114 is driven with the fourth driving phase of −270 degrees. As used herein, the phrase "a monopole antenna element is driven with a phase of θ degrees" refers to "driving a monopole antenna element with a phase angle of θ degrees".

In order to radiate left-hand-circular-polarization electro-magnetic fields from the broad-band circularly-polarized antenna 10, the first monopole antenna element 111 is driven with the first driving phase of 0 degrees, the second monopole antenna element 112 is driven with the second driving phase of +90 degrees, the third monopole antenna element 113 is driven with the third driving phase of +180 degrees, and the fourth monopole antenna element 114 is driven with the fourth driving phase of +270 degrees.

As is shown in FIG. 2, extensions 131'-134' extending in the opposite direction of the respective normals 131-134 intersect at a point 21 on the vertical axis 20. The center of the feed network 150 has an opening through which a support structure 160 is arranged parallel to the vertical axis 20. As is shown in FIG. 2, the support structure 160 is arranged so the vertical axis 20 positioned at the center of the support structure 160. The support structure 160 is fixedly attached to the feed network 150.

The four radiating surfaces 121-124 are equidistant from the vertical axis 20 and thus are also equidistant from the support structure 160. The distance "d" (FIG. 2) between the four broadband monopole antenna elements 111-114 and the central support structure 160 is related to the center operating frequency of the broad-band circularly-polarized antenna 10. The distance "d" is set to optimize the performance of the broad-band circularly-polarized antenna 10. An RF ground connector is connected to the four monopole antenna elements 111-114.

In one implementation of this embodiment, the support structure is a metal pipe. If the support structure is a metal pipe or other metallic mechanical structure, the spacing between monopole broadband radiators and metal support structure is designed to an optimal value so that to the reflection effect from metal support structure is minimized. In this case, the support structure is the RF ground connector.

As is shown in FIG. 2, the monopole antenna elements 111-114 are positioned on respective printed circuit boards (PCB) 126-129. The contact regions 141-144 of the feed network 150 are shown extending under or through the respective PCB's 126-129. In one implementation of this embodiment, the monopole antenna elements 111-114 are printed onto the respective PCB's 126-129. In another implementation of this embodiment, the monopole antenna elements 111-114 are metal plated onto the respective PCB's 126-129. In yet another implementation of this embodiment, the monopole antenna elements 111-114 made by standard tooling processes and the monopole antenna elements 111-114 are attached to the respective PCB's 126-129.

In one implementation of this embodiment, the monopole antenna elements 111-114 emit a circular radiation pattern. In this case, the monopole antenna elements 111-114 are round antenna radiators, and the half-perimeter of each monopole antenna element 111-114 is set to ¼ equivalent wavelength of the emitted radiation. For the global positioning system (GPS) L1 frequency of 1575.42 MHz, the wavelength of emitted radiation is 19 centimeters and the quarter wavelength is about 47.6 mm and the radius of the monopole antenna elements is about 15 mm.

Figure 3:
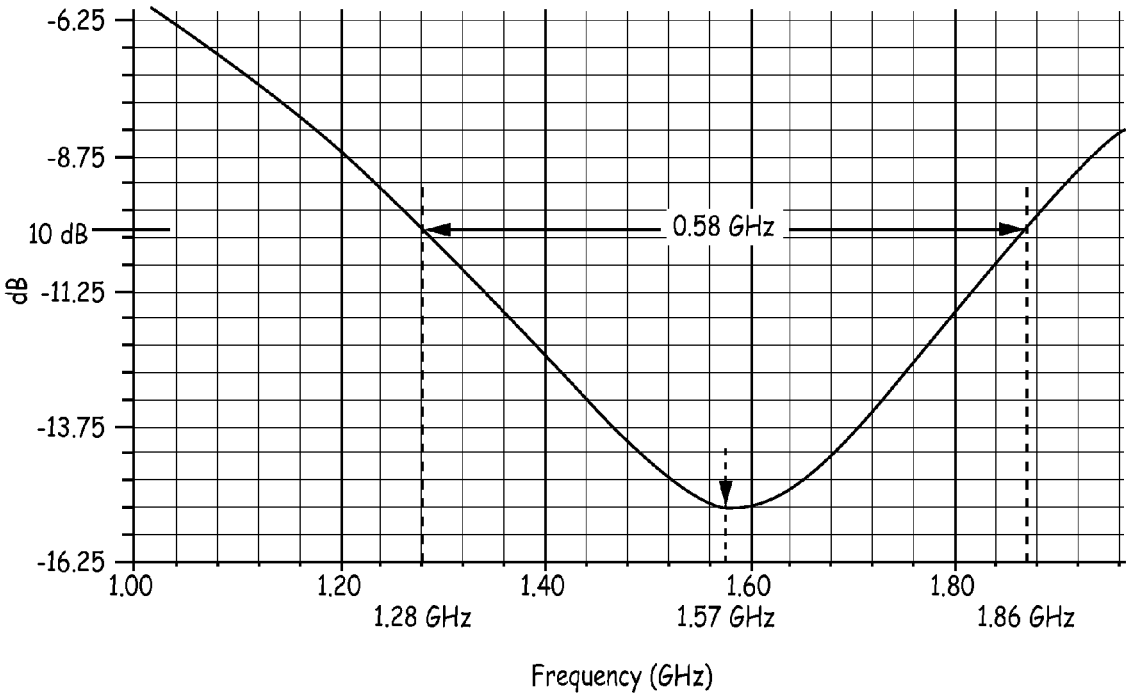
FIG. 3 is a plot of the return loss for the broad-band circularly-polarized antenna of FIG. 1 as a function of frequency.

FIG. 3 is a plot of the return loss for the broad-band circularly-polarized antenna of FIG. 1 as a function of frequency of the emitted radiation. FIG. 3 shows a simulation result using four round radiators (monopole antenna elements 111-114) driven with 0, −90, −180 and −270 phases at the global positioning system (GPS) L1 frequency (1575.42 MHz). The −10 dB bandwidth extends from 1.28 GHz to 1.86 GHz, which is about 36% of the center frequency 1.57 GHz. Return loss provides an indication of impedance match. Negative values in decibels with large magnitude indicate good impedance match which is desirable. A zero dB return loss indicates a bad impedance match due to, for example, terminations with open or short circuits.

FIG. 4 is an oblique view of an embodiment of a bay of monopole antenna elements 111, 112, 113, 114, 211, 212, 213, and 214 that form a broad-band circularly-polarized antenna 11 in accordance with the present invention. The broad-band circularly-polarized antenna 11 is also referred to as a bay 11. The broad-band circularly-polarized antenna 11 includes the monopole antenna elements 111, 112, 113, and 114, which are structured and function as described above with reference to FIGS. 1 and 2, in addition to a fifth monopole antenna element 211, a sixth monopole antenna element 212, a seventh monopole antenna element 213, and an eighth monopole antenna element 214.

The four additional monopole antenna elements 211-214 are arranged around the vertical axis 20 so that the four normals 231-234 of the four respective radiating surfaces 221-224 are perpendicular to the vertical axis 20 and point away from the vertical axis 20. The four monopole antenna elements 211-214 are fed by inductive coupling with the respective adjacent monopole antenna elements 111-114. The feed network 150 is not communicatively coupled to the monopole antenna elements 211-214.

The fifth monopole antenna element 211 has a fifth radiating surface 221 with a fifth normal 231. The fifth monopole antenna element 211 is fed by mutual coupling from the first monopole antenna element 111. The fifth radiating surface 221 of the fifth monopole antenna element 211 and the first radiating surface 121 are in a first plane. As shown in FIG. 4, the first plane is parallel to the PCB 226 that supports both the monopole antenna element 111 and 211.

The sixth monopole antenna element 212 has a sixth radiating surface 222 with a sixth normal 232. The sixth radiating surface 222 of the sixth monopole antenna element 212 is orthogonally arranged with reference to the fifth radiating surface 221 of the fifth monopole antenna element 211. The sixth monopole antenna element 212 is fed by mutual coupling from the second monopole antenna element 112. The sixth radiating surface 222 of the sixth monopole antenna element 212 and the second radiating surface 122 are in a second plane. As shown in FIG. 4, the second plane is parallel to the PCB 227 that supports both the monopole antenna element 112 and 212.

The seventh monopole antenna element 213 has a seventh radiating surface 223 with a seventh normal 233. The seventh radiating surface 223 of the seventh monopole antenna element 213 is orthogonally arranged with reference to the sixth radiating surface 222 of the sixth monopole antenna element 212. The seventh radiating surface 223 of the seventh monopole antenna element 213 is oppositely directed from the fifth monopole antenna element 211 (i.e., normal 231 is oppositely directed from normal 233). The seventh radiating surface 223 of the seventh monopole antenna element 213 and the third radiating surface 123 are in a third plane. The seventh monopole antenna element 213 is fed by mutual coupling from the third monopole antenna element 113. As shown in FIG. 4, the third plane is parallel to the PCB 228 that supports both the monopole antenna element 113 and 213.

The eighth monopole antenna element 214 has an eighth radiating surface 224 with an eighth normal 234. The eighth radiating surface 224 of the eighth monopole antenna element 214 is orthogonally arranged with reference to both the seventh radiating surface 3 of the seventh monopole antenna element 113 and the fifth radiating surface 221 of the fifth monopole antenna element 211. The eighth radiating surface 224 of the eighth monopole antenna element 214 is oppositely directed from the sixth radiating surface 222 of the sixth monopole antenna element 212 (i.e., normal 232 is oppositely directed from normal 234). The eighth radiating surface 224 of the eighth monopole antenna element 214 and the fourth radiating surface 124 are in a fourth plane. The eighth monopole antenna element 214 is fed by mutual coupling from the fourth monopole antenna element 114. As shown in FIG. 4, the fourth plane is parallel to the PCB 229 that supports both the monopole antenna element 113 and 213.

Due to the mutual inductive coupling, the fifth monopole antenna element 211 is driven with the first driving phase that is offset by 90 degrees from the second driving phase that is used to drive the second monopole antenna element 112 and the sixth monopole antenna element 212. Due to the mutual inductive coupling, the sixth monopole antenna element 212 is driven with the second driving phase that is offset by 90 degrees from the third driving phase that is used to drive the third monopole antenna element 113 and the seventh monopole antenna element 213. Due to the mutual inductive coupling, the seventh monopole antenna element 213 is driven with the third driving phase that is offset by 90 degrees from the fourth driving phase used to drive the fourth monopole antenna element 114 and the eighth monopole antenna element 214.

Extensions extending in the opposite direction of the respective normals 231-234 intersect at a point on the vertical axis 20. The four radiating surfaces 221-224 are equidistant from the vertical axis 20 and thus are also equidistant from the support structure 160. As with the monopole antenna elements 111-114, the distance "d" (FIG. 2) between the four broadband monopole antenna elements 211-214 and the central support structure 160 is related to the center operating frequency and is set to optimize the performance of the broad-band circularly-polarized antenna 11.

As shown in FIG. 4, an RF ground connector 161 is connected to the at least four monopole antenna elements 111-114 and extends along the support structure 160 to a ground. In one implementation of this embodiment, the support structure 160 itself is the RF ground connector.

Figure 5:
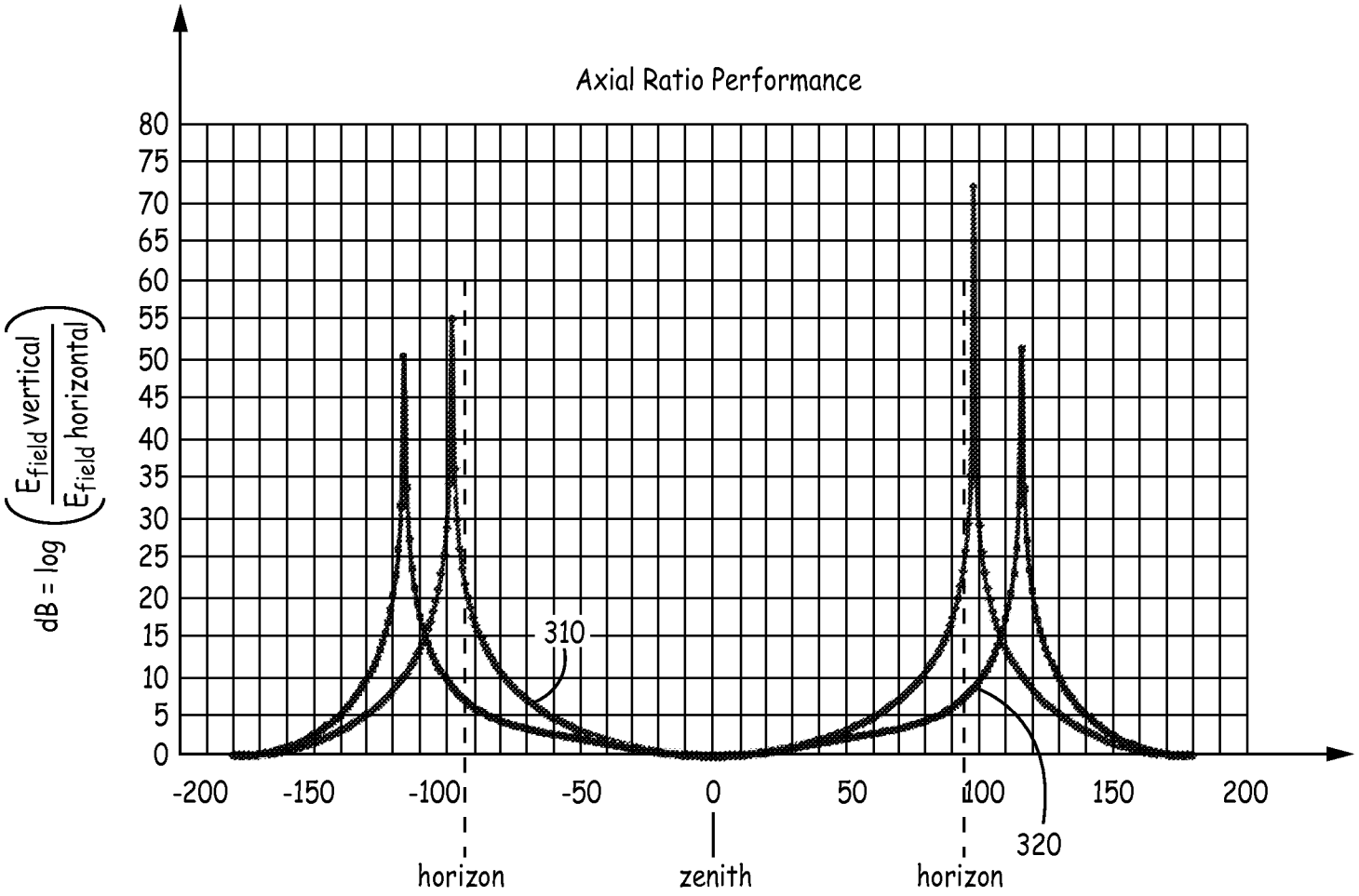
FIG. 5 is a plot of axial ratio performance of the broad-band circularly-polarized antenna of FIG. 4 in both right hand and left hand polarization as a function of elevation.

FIG. 5 is a plot of axial ratio performance of the broad-band circularly-polarized antenna 11 of FIG. 4 in both right hand and left hand polarization as a function of elevation. The zenith (in the Z direction shown in FIG. 4) is at 0 degrees and the horizons are at ±90 degrees. The curve labeled as 310 is the axial ratio performance for right-hand-circular-polarization (RHCP) radiation emitted from the broad-band circularly-polarized antenna 11. In order to radiate right-hand-circular-polarization electro-magnetic fields from the broad-band circularly-polarized antenna 11, the first and fifth monopole antenna elements 111 and 211, respectively, are driven with the first driving phase of 0 degrees, the second and sixth monopole antenna elements 112 and 212, respectively, are driven with the second driving phase of −90 degrees, the third and seventh monopole antenna elements 113 and 213, respectively, are driven with the third driving phase of −180 degrees, and the fourth and eighth monopole antenna elements 114 and 214, respectively, are driven with the fourth driving phase of −270 degrees.

The curve labeled as 320 is the axial ratio performance for left-hand-circular-polarization (LHCP) radiation emitted from the broad-band circularly-polarized antenna 11. In order to radiate left-hand-circular-polarization electro-magnetic fields from the broad-band circularly-polarized antenna 11, the first and fifth monopole antenna elements 111 and 211, respectively, are driven with the first driving phase of 0 degrees, the second and sixth monopole antenna elements 112 and 212, respectively, are driven with the second driving phase of +90 degrees, the third and seventh monopole antenna elements 113 and 213, respectively, are driven with the third driving phase of +180 degrees, and the fourth and eighth monopole antenna elements 114 and 214, respectively, are driven with the fourth driving phase of +270 degrees.

Figure 6:
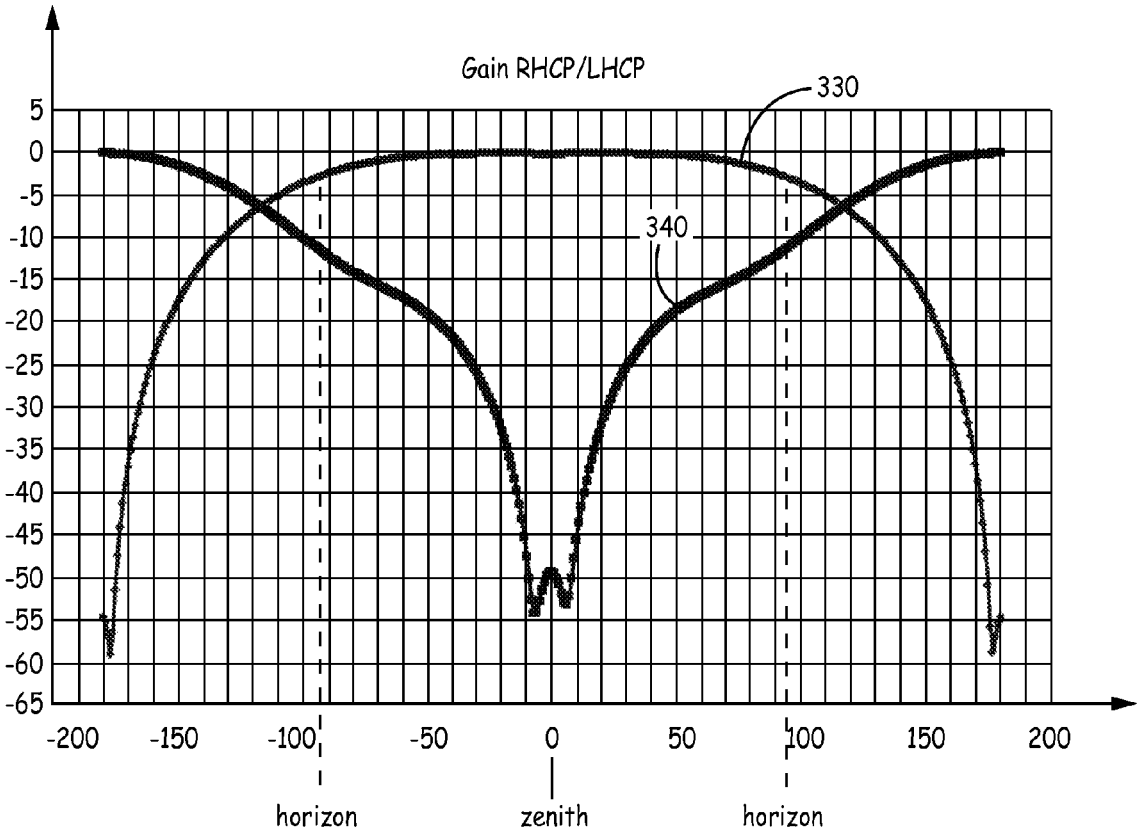
FIG. 6 is a plot of the antenna gain patterns for right hand and left hand polarization as a function of elevation when the broad-band circularly-polarized antenna of FIG. 4 is operational to radiate right-hand-circularly-polarized fields.

FIG. 6 is a plot of the antenna gain patterns for right hand and left hand polarization as a function of elevation when the broad-band circularly-polarized antenna of FIG. 4 is operational to radiate right-hand-circular-polarization fields. The RHCP in decibel (dB) as a function of elevation angle is shown in the curve labeled 330. The LHCP in dB units as a function of elevation angle is shown in the curve labeled 340. At the zenith, the LHCP fields are about 50 dB down from the RHCP fields. At the horizon, the radiation is slightly elliptical and the LHCP fields are about 7 dB down from the RHCP fields.

Figure 7:
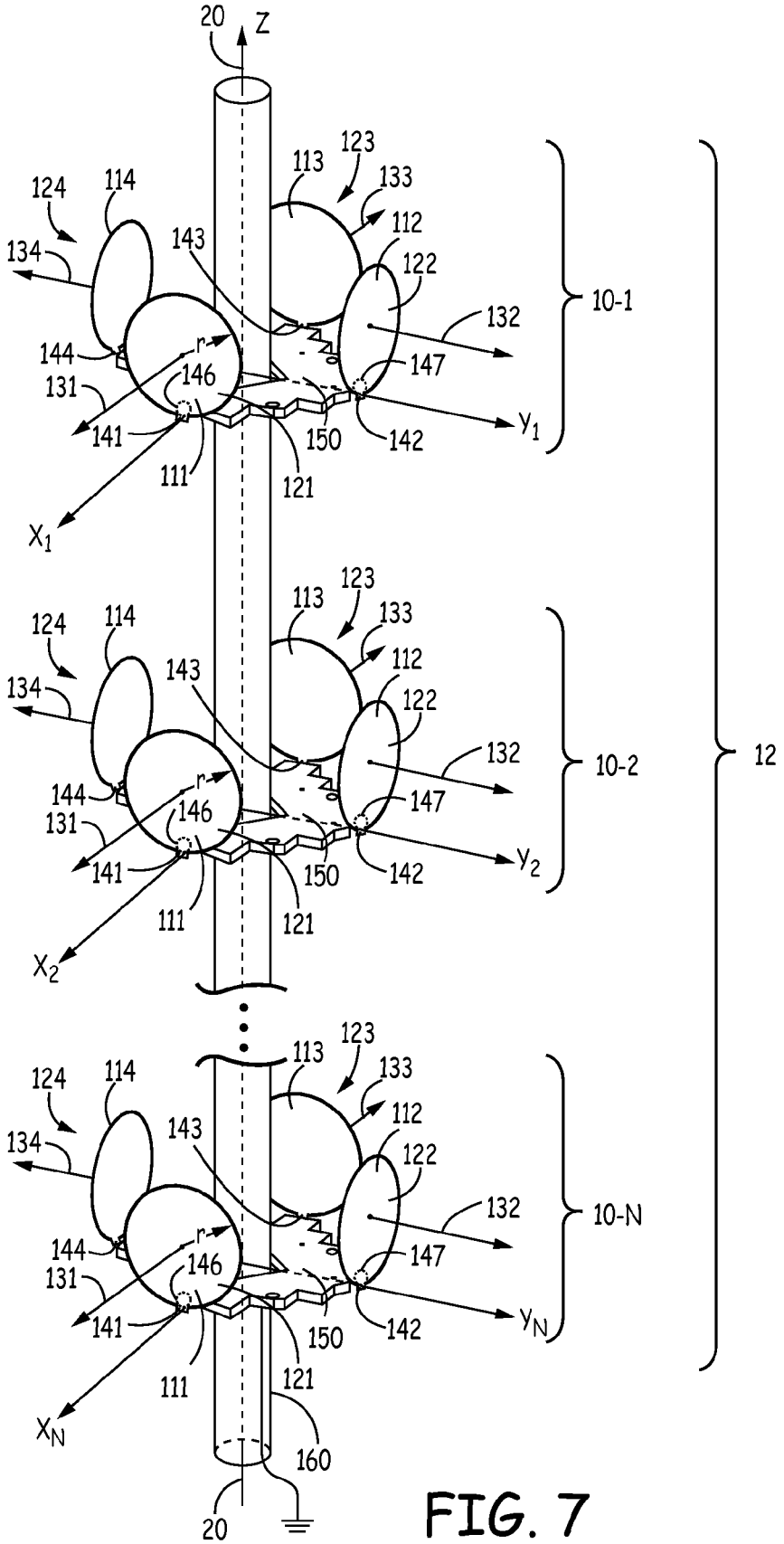
FIG. 7 is an oblique view of an embodiment of a plurality of broad-band circularly-polarized antennas of FIG. 1 that share the same vertical axis and form a broad-band circularly-polarized antenna in accordance with the present invention.

FIG. 7 is an oblique view of an embodiment of a plurality of broad-band circularly-polarized antennas 10(1-N) of FIG. 1 that share the same vertical axis 20 and form a broad-band circularly-polarized antenna 12 in accordance with the present invention. N is a positive integer. As shown in FIG. 7, each of the plurality of broad-band circularly-polarized antennas 10(1-N) shares the same support structure 160, and thus, are aligned to the same vertical axis 20. As shown in FIG. 7, the orientation (in the x, y, z coordinate system) of the vertically stacked broad-band circularly-polarized antennas 10(1-N) are the same. The increased number of broad-band circularly-polarized antennas 10 aligned to the vertical axis 20 improves the antenna gain pattern, increases the power output from the upper hemisphere, yields increased rejection to signals in the lower hemisphere, and gives a sharper cut-off in the transition from above the horizon to below the horizon.

In one implementation of this embodiment, N=3 and there are 12 monopole antenna elements in the broad-band circularly-polarized antenna 12. In one implementation of this embodiment, N is 17 and there are 68 monopole antenna elements in the broad-band circularly-polarized antenna 12.

FIG. 8 is an oblique view of an embodiment of a plurality of broad-band circularly-polarized antennas 11(1-N) of FIG. 4 that share the same vertical axis 20 and form a broad-band circularly-polarized antenna 13 in accordance with the present invention. As shown in FIG. 8, each of the plurality of broad-band circularly-polarized antennas 11(1-N) share the same support structure 160, and thus, are aligned to the same vertical axis 20. As shown in FIG. 8, the orientation (in the x, y, z coordinate system) of the vertically stacked broad-band circularly-polarized antennas 11(1-N) are the same. The larger number of broad-band circularly-polarized antennas 11 aligned to the vertical axis 20 improves the antenna gain pattern, increases the power output from the upper hemisphere, yields increased rejection to signals in the lower hemisphere, and gives a sharper cut-off in the transition from above the horizon to below the horizon. In one implementation of this embodiment, N is 17 and there are 136 monopole antenna elements in the broad-band circularly-polarized antenna 12. For example, a second bay 11-2 of monopole antenna elements 111-114 and 211-214 include a ninth through sixteenth monopole antenna elements 111-114 and 211-214, wherein the ninth through sixteenth monopole antenna elements 111-114 and 211-214 are configured with respect to each other as the first through eight monopole antenna elements 111-114 and 211-214 are configured to each other.

In one implementation of this embodiment, the monopole antenna elements (e.g., monopole antenna elements 111-114) that form any of the broad-band circularly-polarized antennas 10-13 are circular disc monopole antennas with a circular shape. In this case, the circular disc monopole antennas have respective half-perimeters equal to one quarter equivalent wavelengths of the emitted radiation. In another implementation of this embodiment, the monopole antenna elements (e.g., monopole antenna elements 111-114) that form any of the broad-band circularly-polarized antennas 10-13 are bow-tie monopole antennas with a bow-tie shape. In this case, the bow-tie monopole antennas have respective half-perimeters equal to one quarter equivalent wavelengths of the emitted radiation.

FIG. 9 is a method 900 of generating broadband circularly-polarized radiation using a broad-band circularly-polarized antenna in accordance with the present invention. The method 900 is described with reference to the broad-band circularly-polarized antennas of FIGS. 1 and 4, although the method 900 is applicable to other embodiments of the broad-band circularly-polarized antennas.

At block 902, a first radiating surface 121 of a first monopole antenna element 111 is arranged orthogonally to a second radiating surface 122 of a second monopole antenna element 112, in an opposite direction of a third radiating surface 123 of a third monopole antenna element 113 and orthogonally to a fourth radiating surface 124 of a fourth monopole antenna element 114. The first, second, third, and fourth radiating surfaces 121-124 are equidistant from a vertical axis 20 and point away from the vertical axis 20, At block 904, the first monopole antenna element 111 is driven with a first driving phase.

At block 906, the second monopole antenna element 112 is driven with a second driving phase offset by 90 degrees from the first driving phase.

At block 908, the third monopole antenna element 113 is driven with a third driving phase offset by 90 degrees from the second driving phase and offset from the first driving phase by 180 degrees.

At block 910, the fourth monopole antenna element 114 is driven with a fourth driving phase offset by 90 degrees from the third driving phase, offset by 180 degrees from the second driving phase, and offset from the first driving phase by 270 degrees.

When the first monopole antenna element 111 is driven with the first driving phase of 0 degrees; the second monopole antenna element 112 is driven with the second driving phase of −90 degrees; the third monopole antenna element is driven with the third driving phase of −180 degrees; and the fourth monopole antenna element is driven with the fourth driving phase of −270 degrees, the broad-band circularly-polarized antenna radiates right-hand-circular-polarization fields.

Likewise, when the first driving phase is 0 degrees, the second monopole antenna element 112 is driven with the second driving phase of +90 degrees; the third monopole antenna element is driven with the third driving phase of +180 degrees; and the fourth monopole antenna element is driven with the fourth driving phase of +270 degrees, the broad-band circularly-polarized antenna radiates left-hand-circular-polarization fields.

When the broad-band circularly-polarized antenna includes eight monopole antenna elements in a bay, then a fifth radiating surface of a fifth monopole antenna element is arranged orthogonally to a sixth radiating surface of a sixth monopole antenna element, in an opposite direction of a seventh radiating surface of a seventh monopole antenna element and orthogonally to an eighth radiating surface of an eighth monopole antenna element. The fifth, sixth, seventh and eight radiating surfaces are equidistant from the vertical axis, and point away from the vertical axis. In this embodiment, the fifth monopole antenna element is inductively coupled with the first driving phase when driving the first monopole antenna element, the sixth monopole antenna element is inductively coupled with the second driving phase when driving the second monopole antenna element, the seventh monopole antenna element is inductively coupled with the third driving phase when driving the third monopole antenna element, and the eighth monopole antenna element is inductively coupled with the fourth driving phase when driving the fourth monopole antenna element.

By implementation of this method, the prior art 45 degree dipole orientation is no longer necessary. The monopole antenna elements are easily assembled to form an antenna with a broad bandwidth thereby extending the operating frequency range of the antenna.

EXAMPLE EMBODIMENTS

Example 1 includes a broad-band circularly-polarized antenna comprising: at least four monopole antenna elements having respective at least four radiating surfaces with respective at least four normals, the at least four monopole antenna elements arranged around a vertical axis so that the at least four normals of the at least four respective radiating surfaces are perpendicular to the vertical axis and point away from the vertical axis; at least one feed network communicatively coupled to at least four respective edge portions of the at least four monopole antenna elements, wherein a first monopole antenna element is driven with a first driving phase offset by 90 degrees from a second driving phase used to drive a second monopole antenna element, wherein a second radiating surface of the second monopole antenna element is orthogonally arranged with reference to a first radiating surface of the first monopole antenna element, wherein the second driving phase is offset by 90 degrees from a third driving phase used to drive a third monopole antenna element, a third radiating surface of the third monopole antenna element being orthogonally arranged with reference to the second radiating surface of the second monopole antenna element, and the third radiating surface of the third monopole antenna element being oppositely directed from the first radiating surface of the first monopole antenna element, wherein the third driving phase is offset by 90 degrees from a fourth driving phase used to drive a fourth monopole antenna element, a fourth radiating surface of the fourth monopole antenna element being orthogonally arranged with reference to both the third radiating surface of the third monopole antenna element and the first radiating surface of the first monopole antenna element, and the fourth radiating surface of the fourth monopole antenna element being oppositely directed from the second radiating surface of the second monopole antenna element.

Example 2 includes the broad-band circularly-polarized antenna of Example 1, wherein the first monopole antenna element is driven with the first driving phase of 0 degrees, the second monopole antenna element is driven with the second driving phase of −90 degrees, the third monopole antenna element is driven with the third driving phase of −180 degrees, and the fourth monopole antenna element is driven with the fourth driving phase of −270 degrees to radiate right-hand-circular-polarization fields.

Example 3 includes the broad-band circularly-polarized antenna of Example 1, wherein a first monopole antenna element is driven with the first driving phase of 0 degrees, the second monopole antenna element is driven with the second driving phase of +90 degrees, the third monopole antenna element is driven with the third driving phase of +180 degrees, and the fourth monopole antenna element is driven with the fourth driving phase of +270 degrees to radiate left-hand-circular-polarization fields.

Example 4 includes the broad-band circularly-polarized antenna of any of Examples 1-3, further comprising: a fifth monopole antenna element having a fifth radiating surface; a sixth monopole antenna element having a sixth radiating surface; a seventh monopole antenna element having a seventh radiating surface; and an eighth monopole antenna element having an eighth radiating surface, wherein the fifth radiating surface of the fifth monopole antenna element and the first radiating surface are in a first plane and the fifth monopole antenna element is fed by mutual coupling from the first monopole antenna element, wherein the sixth radiating surface and the second radiating surface are in a second plane and the sixth monopole antenna element is fed by mutual coupling from the second monopole antenna element, wherein the seventh radiating surface and the third radiating surface are in a third plane and the seventh monopole antenna element is fed by mutual coupling from the third monopole antenna element, wherein the eighth radiating surface and the third radiating surface are in a fourth plane and the eighth monopole antenna element is fed by mutual coupling from the fourth monopole antenna element, wherein the first to eighth monopole antenna elements form a bay of monopole antenna elements.

Example 5 includes the broad-band circularly-polarized antenna of Example 4, wherein the bay of monopole antenna elements is a first bay of monopole antenna elements, the antenna further comprising: a second bay of monopole antenna elements including an additional ninth through sixteenth monopole antenna elements, wherein the ninth through sixteenth monopole antenna elements are configured with respect to each other as the first through eight monopole antenna elements are configured to each other.

Example 6 includes the broad-band circularly-polarized antenna of any of Examples 1-5, wherein the at least four radiating surfaces are equidistant from the vertical axis, and wherein extensions of the respective at least four normals intersect at a point on the vertical axis.

Example 7 includes the broad-band circularly-polarized antenna of any of Examples 1-6, further comprising: an RF ground connector connected to the at least four monopole antenna elements.

Example 8 includes the broad-band circularly-polarized antenna of any of Examples 1-7, further comprising: a support structure is arranged parallel to the vertical axis, the support structure fixedly attached to the at least one feed network.

Example 9 includes the broad-band circularly-polarized antenna of any of Examples 1-8, wherein the at least four monopole antenna elements are at least four circular disc monopole antennas.

Example 10 includes the broad-band circularly-polarized antenna of Example 9, wherein the at least four circular disc monopole antennas have respective half-perimeters equal to one quarter equivalent wavelengths of the emitted radiation.

Example 11 includes the broad-band circularly-polarized antenna of any of Examples 1-10, wherein the at least four monopole antenna elements each emit radiation in one of a bow-tie shape or a circular shape Example 12 includes a method of generating broadband circularly-polarized radiation, the method comprising: arranging a first radiating surface of a first monopole antenna element orthogonally to a second radiating surface of a second monopole antenna element, in an opposite direction of a third radiating surface of a third monopole antenna element and orthogonally to a fourth radiating surface of a fourth monopole antenna element, wherein the first, second, third, and fourth radiating surfaces are equidistant from a vertical axis, and point away from the vertical axis; driving the first monopole antenna element with a first driving phase; driving the second monopole antenna element with a second driving phase offset by 90 degrees from the first driving phase; driving the third monopole antenna element with a third driving phase offset by 90 degrees from the second driving phase and offset from the first driving phase by 180 degrees; and driving the fourth monopole antenna element with a fourth driving phase offset by 90 degrees from the third driving phase, offset by 180 degrees from the second driving phase and offset from the first driving phase by 270 degrees.

Example 13 includes the method of Example 12, wherein driving the first monopole antenna element with the first driving phase comprises driving the first monopole antenna element with the first driving phase of 0 degrees; wherein driving the second monopole antenna element with the second driving phase comprises driving the second monopole antenna element with the second driving phase of −90 degrees; wherein driving the third monopole antenna element with the third driving phase comprises driving the third monopole antenna element with the third driving phase of −180 degrees; and wherein driving the fourth monopole antenna element with the fourth driving phase comprises driving the fourth monopole antenna element with the fourth driving phase of −270 degrees.

Example 14 includes the method of Example 12, wherein driving the first monopole antenna element with the first driving phase comprises driving the first monopole antenna element with the first driving phase of 0 degrees; wherein driving the second monopole antenna element with the second driving phase comprises driving the second monopole antenna element with the second driving phase of +90 degrees; wherein driving the third monopole antenna element with the third driving phase comprises driving the third monopole antenna element with the third driving phase of +180 degrees; and wherein driving the fourth monopole antenna element with the fourth driving phase comprises driving the fourth monopole antenna element with the fourth driving phase of +270 degrees.

Example 15 includes the method of any of Examples 12-14, further comprising: arranging a fifth radiating surface of a fifth monopole antenna element orthogonally to a sixth radiating surface of a sixth monopole antenna element, in an opposite direction of a seventh radiating surface of a seventh monopole antenna element and orthogonally to an eighth radiating surface of an eighth monopole antenna element, wherein the fifth, sixth, seventh and eight radiating surfaces are equidistant from the vertical axis, and point away from the vertical axis.

Example 16 includes the method of Example 15, further comprising: inductively coupling the fifth monopole antenna element with the first driving phase when driving the first monopole antenna element; inductively coupling the sixth monopole antenna element with the second driving phase when driving the second monopole antenna element; inductively coupling the seventh monopole antenna element with the third driving phase when driving the third monopole antenna element; and inductively coupling the eighth monopole antenna element with the fourth driving phase when driving the fourth monopole antenna element.

Example 17 includes a broad-band circularly-polarized antenna comprising: at least four monopole antenna elements arranged around a vertical axis so that normals of at least four respective radiating surfaces of the at least four monopole antenna elements are perpendicular to the vertical axis and point away from the vertical axis, wherein a first monopole antenna element is driven with the first driving phase of 0 degrees, the second monopole antenna element is driven with a second driving phase of one of −90 degrees or +90 degrees, the third monopole antenna element is driven with a third driving phase of a respective one of −180 degrees or +180 degrees, and the fourth monopole antenna element is driven with a fourth driving phase of a respective one of −270 degrees or +270 degrees to radiate a respective one of right-hand-circular-polarization fields or left-hand-circular-polarization fields.

Example 18 includes the broad-band circularly-polarized antenna of Example 17, further comprising: a first monopole antenna element having a first radiating surface; a second monopole antenna element having a second radiating surface; a third monopole antenna element having a third radiating surface; and a fourth monopole antenna element having a fourth radiating surface; a fifth monopole antenna element having a fifth radiating surface; a sixth monopole antenna element having a sixth radiating surface; a seventh monopole antenna element having a seventh radiating surface; and an eighth monopole antenna element having an eighth radiating surface, a fed network communicatively coupled to at least four respective edge portions of the first, second, third, and fourth monopole antenna elements, wherein the fifth radiating surface of the fifth monopole antenna element and the first radiating surface are in a first plane and the fifth monopole antenna element is fed by mutual coupling from the first monopole antenna element, wherein the sixth radiating surface and the second radiating surface are in a second plane and the sixth monopole antenna element is fed by mutual coupling from the second monopole antenna element, wherein the seventh radiating surface and the third radiating surface are in a third plane and the seventh monopole antenna element is fed by mutual coupling from the third monopole antenna element, wherein the eighth radiating surface and the third radiating surface are in a fourth plane and the eighth monopole antenna element is fed by mutual coupling from the fourth monopole antenna element, wherein the first to eighth monopole antenna elements form a bay of monopole antenna elements.

Example 19 includes the broad-band circularly-polarized antenna of Example 18, wherein the at least four radiating surfaces are equidistant from the vertical axis, and wherein extensions of the respective at least four normals intersect at a point on the vertical axis.

Example 20 includes the broad-band circularly-polarized antenna of any of Examples 18-19, further comprising: an RF ground connector connected to the at least four monopole antenna elements.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A broad-band circularly-polarized antenna comprising:

at least four monopole antenna elements having respective at least four radiating surfaces with respective at least four normals, the at least four monopole antenna elements arranged around a vertical axis so that the at least four normals of the at least four respective radiating surfaces are perpendicular to the vertical axis and point away from the vertical axis, wherein the at least four monopole antenna elements are connected to a ground reference;

at least one feed network having at least four contact regions, wherein the feed network is communicatively coupled to at least four respective edge portions of the at least four monopole antenna elements via the at least four contact regions, wherein a first monopole antenna element is driven with a first driving phase offset by 90 degrees from a second driving phase used to drive a second monopole antenna element, wherein a second radiating surface of the second monopole antenna element is orthogonally arranged with reference to a first radiating surface of the first monopole antenna element, wherein the second driving phase is offset by 90 degrees from a third driving phase used to drive a third monopole antenna element, a third radiating surface of the third monopole antenna element being orthogonally arranged with reference to the second radiating surface of the second monopole antenna element, and the third radiating surface of the third monopole antenna element being oppositely directed from the first radiating surface of the first monopole antenna element, wherein the third driving phase is offset by 90 degrees from a fourth driving phase used to drive a fourth monopole antenna element, a fourth radiating surface of the fourth monopole antenna element being orthogonally arranged with reference to both the third radiating surface of the third monopole antenna element and the first radiating surface of the first monopole antenna element, and the fourth radiating surface of the fourth monopole antenna element being oppositely directed from the second radiating surface of the second monopole antenna element.

2. The broad-band circularly-polarized antenna of claim 1, wherein the first monopole antenna element is driven with the first driving phase of 0 degrees, the second monopole antenna element is driven with the second driving phase of −90 degrees, the third monopole antenna element is driven with the third driving phase of −180 degrees, and the fourth monopole antenna element is driven with the fourth driving phase of −270 degrees to radiate right-hand-circular-polarization fields.

3. The broad-band circularly-polarized antenna of claim 1, wherein a first monopole antenna element is driven with the first driving phase of 0 degrees, the second monopole antenna element is driven with the second driving phase of +90 degrees, the third monopole antenna element is driven with the third driving phase of +180 degrees, and the fourth monopole antenna element is driven with the fourth driving phase of +270 degrees to radiate left-hand-circular-polarization fields.

4. The broad-band circularly-polarized antenna of claim 1, further comprising:

a fifth monopole antenna element having a fifth radiating surface;

a sixth monopole antenna element having a sixth radiating surface;

a seventh monopole antenna element having a seventh radiating surface; and an eighth monopole antenna element having an eighth radiating surface, wherein the fifth radiating surface of the fifth monopole antenna element and the first radiating surface are in a first plane and the fifth monopole antenna element is fed by mutual coupling from the first monopole antenna element, wherein the sixth radiating surface and the second radiating surface are in a second plane and the sixth monopole antenna element is fed by mutual coupling from the second monopole antenna element, wherein the seventh radiating surface and the third radiating surface are in a third plane and the seventh monopole antenna element is fed by mutual coupling from the third monopole antenna element, wherein the eighth radiating surface and the third radiating surface are in a fourth plane and the eighth monopole antenna element is fed by mutual coupling from the fourth monopole antenna element, wherein the first to eighth monopole antenna elements form a bay of monopole antenna elements.

5. The broad-band circularly-polarized antenna of claim 4, wherein the bay of monopole antenna elements is a first bay of monopole antenna elements, the antenna further comprising:

a second bay of monopole antenna elements including an additional ninth through sixteenth monopole antenna elements, wherein the ninth through sixteenth monopole antenna elements are configured with respect to each other as the first through eight monopole antenna elements are configured to each other.

6. The broad-band circularly-polarized antenna of claim 1, wherein the at least four radiating surfaces are equidistant from the vertical axis, and wherein extensions of the respective at least four normals intersect at a point on the vertical axis.

7. The broad-band circularly-polarized antenna of claim 1, further comprising:

a support structure is arranged parallel to the vertical axis, the support structure fixedly attached to the at least one feed network.

8. The broad-band circularly-polarized antenna of claim 1, wherein the at least four monopole antenna elements are at least four circular disc monopole antennas.

9. The broad-band circularly-polarized antenna of claim 8, wherein the at least four circular disc monopole antennas have respective half-perimeters equal to one quarter equivalent wavelengths of the emitted radiation.

10. The broad-band circularly-polarized antenna of claim 1, wherein the at least four monopole antenna elements each emits radiation in one of a bow-tie shape or a circular shape.

11. A method of generating broadband circularly-polarized radiation, the method comprising:

arranging a first radiating surface of a first monopole antenna element orthogonally to a second radiating surface of a second monopole antenna element, in an opposite direction of a third radiating surface of a third monopole antenna element and orthogonally to a fourth radiating surface of a fourth monopole antenna element, wherein the first, second, third, and fourth radiating surfaces are equidistant from a vertical axis, and point away from the vertical axis, and wherein the at least four monopole antenna elements are connected to a ground reference;

communicatively coupling respective edge portions of the first monopole antenna element, the second monopole antenna element, the third monopole antenna element and the fourth monopole antenna element to a feed network via at least four respective contact regions included in the feed network;

driving the first monopole antenna element with a first driving phase;

driving the second monopole antenna element with a second driving phase offset by 90 degrees from the first driving phase;

driving the third monopole antenna element with a third driving phase offset by 90 degrees from the second driving phase and offset from the first driving phase by 180 degrees; and driving the fourth monopole antenna element with a fourth driving phase offset by 90 degrees from the third driving phase, offset by 180 degrees from the second driving phase and offset from the first driving phase by 270 degrees.

12. The method of claim 11, wherein driving the first monopole antenna element with the first driving phase comprises driving the first monopole antenna element with the first driving phase of 0 degrees;

wherein driving the second monopole antenna element with the second driving phase comprises driving the second monopole antenna element with the second driving phase of −90 degrees;

wherein driving the third monopole antenna element with the third driving phase comprises driving the third monopole antenna element with the third driving phase of −180 degrees; and wherein driving the fourth monopole antenna element with the fourth driving phase comprises driving the fourth monopole antenna element with the fourth driving phase of −270 degrees.

13. The method of claim 11, wherein driving the first monopole antenna element with the first driving phase comprises driving the first monopole antenna element with the first driving phase of 0 degrees;

wherein driving the second monopole antenna element with the second driving phase comprises driving the second monopole antenna element with the second driving phase of +90 degrees;

wherein driving the third monopole antenna element with the third driving phase comprises driving the third monopole antenna element with the third driving phase of +180 degrees; and wherein driving the fourth monopole antenna element with the fourth driving phase comprises driving the fourth monopole antenna element with the fourth driving phase of +270 degrees.

14. The method of claim 11, further comprising:

arranging a fifth radiating surface of a fifth monopole antenna element orthogonally to a sixth radiating surface of a sixth monopole antenna element, in an opposite direction of a seventh radiating surface of a seventh monopole antenna element and orthogonally to an eighth radiating surface of an eighth monopole antenna element, wherein the fifth, sixth, seventh and eight radiating surfaces are equidistant from the vertical axis, and point away from the vertical axis.

15. The method of claim 14, further comprising:

inductively coupling the fifth monopole antenna element with the first driving phase when driving the first monopole antenna element;

inductively coupling the sixth monopole antenna element with the second driving phase when driving the second monopole antenna element;

inductively coupling the seventh monopole antenna element with the third driving phase when driving the third monopole antenna element; and inductively coupling the eighth monopole antenna element with the fourth driving phase when driving the fourth monopole antenna element.

16. A broad-band circularly-polarized antenna comprising:

at least four monopole antenna elements arranged around a vertical axis so that normals of at least four respective radiating surfaces of the at least four monopole antenna elements are perpendicular to the vertical axis and point away from the vertical axis, wherein a first monopole antenna element is driven with a first driving phase of 0 degrees, a second monopole antenna element is driven with a second driving phase of one of −90 degrees or +90 degrees, a third monopole antenna element is driven with a third driving phase of a respective one of −180 degrees or +180 degrees, and a fourth monopole antenna element is driven with a fourth driving phase of a respective one of −270 degrees or +270 degrees to radiate a respective one of right-hand-circular-polarization fields or left-hand-circular-polarization fields, and wherein the at least four monopole antenna elements are connected to a ground reference; and a feed network having at least four contact regions, wherein the feed network is communicatively coupled to at least four respective edge portions of the at least four monopole antenna elements via the at least four contact regions.

17. The broad-band circularly-polarized antenna of claim 16, further comprising:

the first monopole antenna element having a first radiating surface;

the second monopole antenna element having a second radiating surface;

the third monopole antenna element having a third radiating surface; and the fourth monopole antenna element having a fourth radiating surface;

a fifth monopole antenna element having a fifth radiating surface;

a sixth monopole antenna element having a sixth radiating surface;

a seventh monopole antenna element having a seventh radiating surface; and an eighth monopole antenna element having an eighth radiating surface, wherein the fifth radiating surface of the fifth monopole antenna element and the first radiating surface are in a first plane and the fifth monopole antenna element is fed by mutual coupling from the first monopole antenna element, wherein the sixth radiating surface and the second radiating surface are in a second plane and the sixth monopole antenna element is fed by mutual coupling from the second monopole antenna element, wherein the seventh radiating surface and the third radiating surface are in a third plane and the seventh monopole antenna element is fed by mutual coupling from the third monopole antenna element, wherein the eighth radiating surface and the third radiating surface are in a fourth plane and the eighth monopole antenna element is fed by mutual coupling from the fourth monopole antenna element, wherein the first to eighth monopole antenna elements form a bay of monopole antenna elements.

18. The broad-band circularly-polarized antenna of claim 17, wherein the at least four radiating surfaces are equidistant from the vertical axis, and wherein extensions of the respective at least four normals intersect at a point on the vertical axis.

* * * * *